United States Patent [19]

Edman

[11] Patent Number: 4,604,820

[45] Date of Patent: Aug. 12, 1986

[54] MODULAR SIGN

[75] Inventor: David C. Edman, Camp Hill, Pa.

[73] Assignee: Build-A-Sign, Inc., Mechanicsburg, Pa.

[21] Appl. No.: 693,976

[22] Filed: Jan. 23, 1985

[51] Int. Cl.[4] ..... G09F 7/00

[52] U.S. Cl. ..... 40/605; 40/611

[58] Field of Search ..... 40/585, 605, 611, 575, 40/589, 489, 607; 52/105, 578

[56] References Cited

U.S. PATENT DOCUMENTS

| | | | |
|---|---|---|---|
| 758,088 | 4/1904 | Mixer | 40/611 |
| 892,615 | 7/1908 | Perry | 40/605 |
| 1,270,883 | 7/1918 | Scott | 40/606 |
| 1,866,554 | 7/1932 | Fairbanks | 40/617 |
| 1,880,828 | 10/1932 | Courtenay | 40/152.1 |
| 2,048,359 | 7/1936 | Snell | 40/605 |
| 2,064,127 | 12/1936 | Schneider | 40/606 |
| 2,388,180 | 10/1945 | Pulver | 40/606 |
| 2,631,392 | 3/1953 | Stevenson | 40/606 |
| 2,802,291 | 8/1957 | Bach et al. | 40/605 |
| 3,132,431 | 5/1961 | Petrie | 40/611 |
| 3,289,337 | 12/1966 | Golkowski | 40/606 |
| 3,432,954 | 3/1969 | Ford | 40/202 |
| 3,935,653 | 2/1976 | Klein | 40/606 |
| 4,092,792 | 6/1978 | Vorhees | 40/611 |

FOREIGN PATENT DOCUMENTS

| | | | |
|---|---|---|---|
| 2048540 | 12/1980 | United Kingdom | 40/611 |

*Primary Examiner*—Robert Peshock
*Assistant Examiner*—Cary E. Stone
*Attorney, Agent, or Firm*—Thomas Hooker

[57] ABSTRACT

A modular sign including a rectangular frame supporting an assembly of interlocking panel members. The ends of the members extend into channels on the sides of the frame, the bottom member snap locks the bead on the bottom of the frame, and a top member removably secures the assembly in the frame and includes a roof extending across the top of the frame.

11 Claims, 8 Drawing Figures

FIG. 1
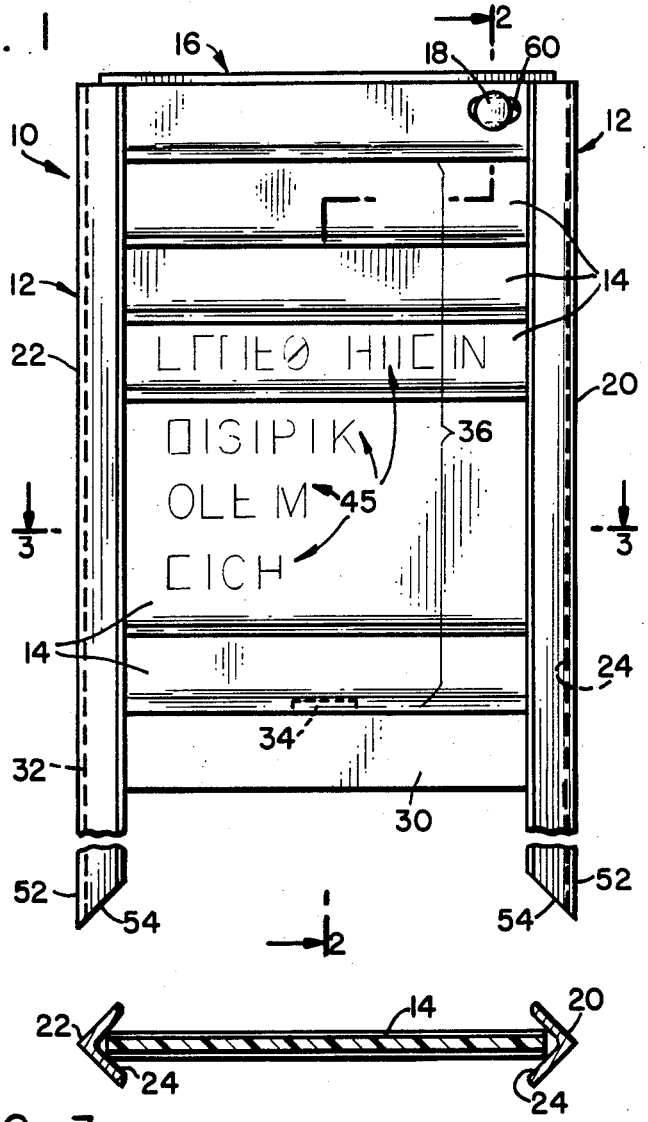
FIG. 2
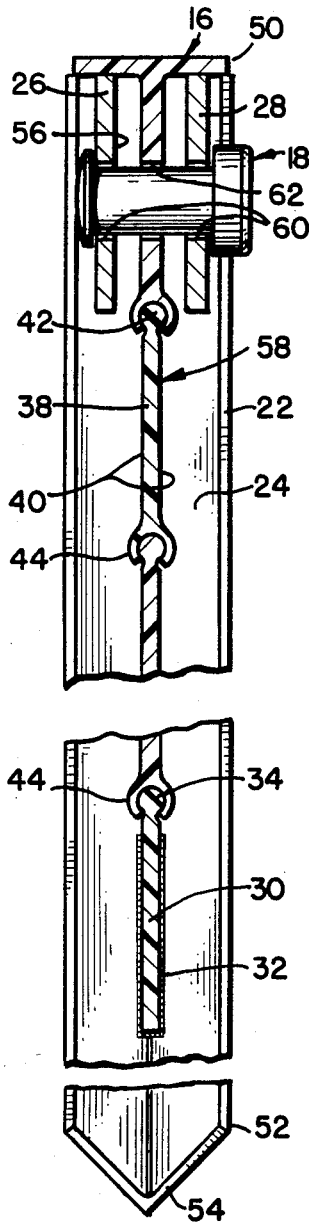
FIG. 3
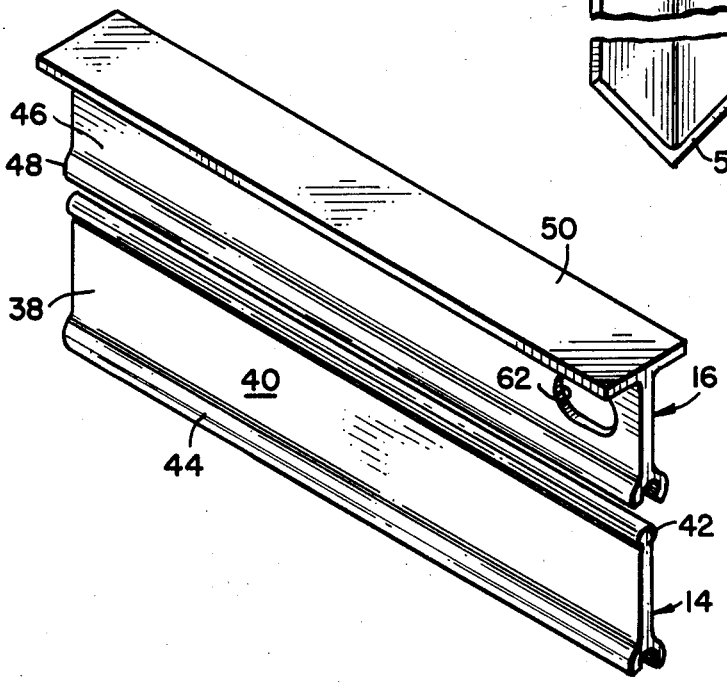
FIG. 4

FIG. 5
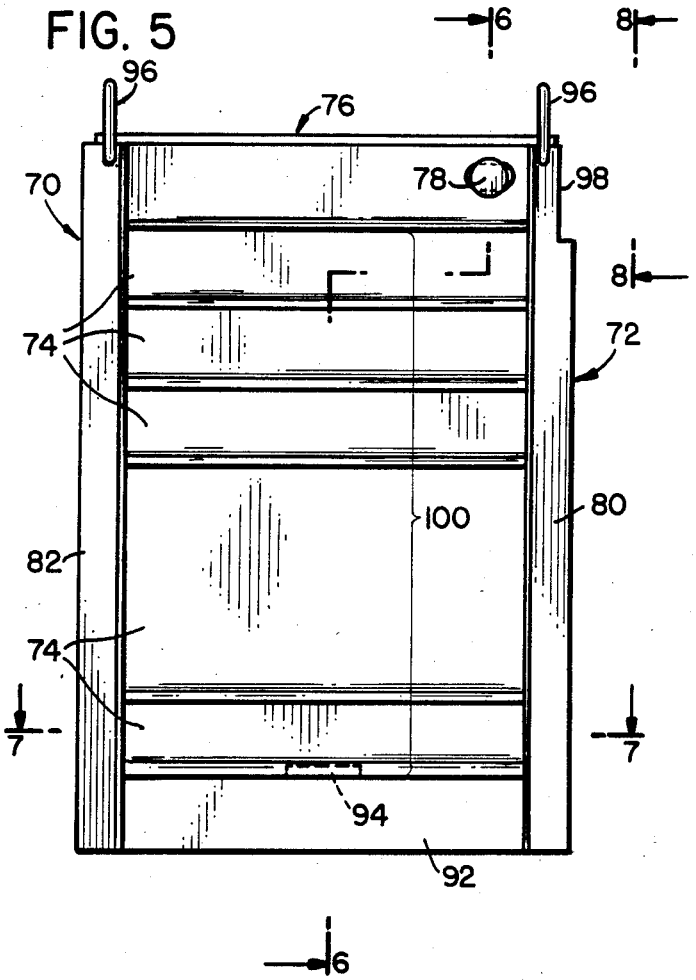
FIG. 6
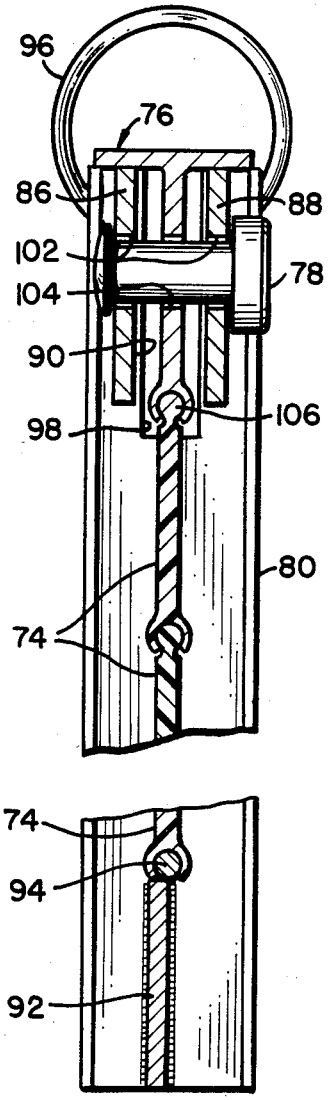
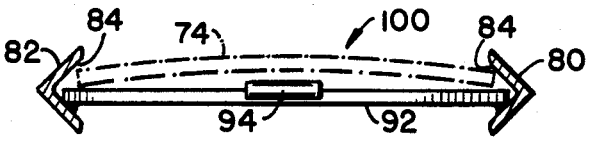
FIG. 7
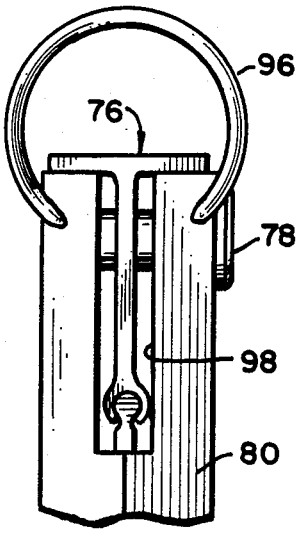
FIG. 8

MODULAR SIGN

This invention relates to an improved modular sign of the type used to display panels bearing information which may be readily removed from the sign frame and entirely or partially replaced at will without the necessity of relocating the frame. The sign may include legs for mounting in the ground, frequently at roadside location for display to people traveling along the road or may be hung from a suitable support.

Signs including frames with removable and replaceable diplay panels are shown in U.S. Pat. Nos. 2,631,392, 3,132,431 and 3,289,337.

The improved modular sign of the present invention is used to diaplay information which is likely to be altered periodically while the sign is in place. The modular construction of the sign permits easy replacement of individual panel members which carry the advertising or information. The members are positively secured within a surrounding and strong frame to prevent accidental or unauthorized changes. Different widths and heights of panels may be used as required for different displays within given sign frame, thereby permitting great freedom in selecting a display.

Two embodiments of the improved sign are described. In the first embodiment the sign frame includes spaced legs suitable for driving into the ground. This embodiment sign may be erected at roadside for display purposes in connection with realty which is for sale or for rent. The sign is an improvement over conventional single paneled realty signs. A change in the display of a conventional sign requires removal and replacement of the entire panel, and removal and replacement of the entire sign when the panel is an integral part of the sign.

In a second embodiment, the sign includes hanging rings for suspension from a support, such as a wall bracket, mailbox or the like. This embodiment modular sign may be used for the same purposes as the first embodiment and additionally to display the occupants of a business or apartment structure and to advertise goods or services.

The first embodiment sign is mounted on the ground so that the bottom of the frame is normally flush on the ground. The modular panel assembly is top loaded into the frame so that the display may be changed without the necessity of moving or repositioning the frame. In the second embodiment sign the frame is hung from the top and the panel assembly is inserted and withdrawn from the bottom of the sign. This can be accomplished without taking down the sign. Thus, the second embodiment sign may be permanently mounted on a support and the individual panel displays changed at will. Both embodiments include roofs to protect the removable panels from snow and ice and facilitate changing panels in the wintertime.

Other objects and features of the invention will become apparent as the description proceeds, especially when taken in conjunction with the accompanying drawings illustrating the invention, of which there are two sheets and two embodiments. In the Drawings:

FIG. 1 is a side view of a sign according to the invention;

FIGS. 2 and 3 are sectional views taken respectively along lines 2—2 and 3—3 of FIG. 1;

FIG. 4 is a perspective view of a pair of elements used in the sign of FIG. 1;

FIG. 5 is a side view of a second embodiment sign;

FIGS. 6 and 7 are sectional views taken respectfully along lines 6—6 and 7—7 of FIG. 5; and FIG. 8 is a partial view taken in the direction of arrows 8—8 of FIG. 5.

Referring to FIGS. 1 through 4, modular sign 10 includes a rectangular frame 12, an assembly S of similar interlocking panel members 14, a top member 16 and a lock 18 which prevents unauthorized disassembly of the sign.

Frame 12 includes a pair of spaced vertical channel members 20 and 22 having V-shaped cross sections with channels 24 facing the interior of the frame 12 as shown in FIG. 3. The channel members have a uniform cross section along the height of the sign 10.

A pair of spaced top rails 26 and 28 extend across the top of the frame and are joined at their ends to the upper ends of the channel members 22 and 24. The tops of the rails and channel members are flush as indicated in FIGS. 1 and 2. A single bottom rail 30 extends across the bottom of the frame and is joined to the bottoms of the channel members 20 and 22 in the center of the channels 24 at 32 as illustrated in FIGS. 1 and 2. A rounded locking bead 34 extends along the top center of rail 30.

The interior of the rectangular frame 10 is filled by an assembly of interlocking panel members 14 indicated by bracket 36 in FIG. 1. The individual members may have different heights as required for a given display. Each panel member 36 extends longitudinally between channel members 20 and 22 and includes a flat central panel 38 defining flat display sides 40, a locking bead 42 extending along the top of the panel and a C-shaped locking clasp 44 extending along the bottom of the panel. The locking beads 41 have a snug sliding fit within the locking clasps 42.

As illustrated in FIG. 1, the sign 10 may include a plurality of panel members 14 having different heights as desired. Display information, indicated generally at 45, is printed on the panel member surfaces 40. Partial width panels may be used with other types of partial width panels in place of a single full width panel.

Top member 16 includes a flat elongate central panel 46 like panel 38, an elongate C-shaped locking clasp 48, like clasp 44, extending along the bottom of the panel 46 and an elongate top plate or roof 50 extending along and laterally to either side of the top of the panel so that, as illustrated in FIGS. 2 and 4, the top member 16 has a generally T-shaped transverse cross section.

The lower ends of channel members 20 and 22 may extend below the bottom rail 30 to form a pair of legs 52 with beveled pointed ends 54. The legs are be pushed down into the ground to permit erecting the sign at a desired location, conventionally a roadside location for display of information on the panel members concerning businesses, sale of real estate and the like.

The interior of the sign frame 12 is filled by the assembly of panel members 36 as indicated in FIG. 1. Individual panel members carrying appropriate indicia may be selected and matched in order to create a sign display appropriate for a given location and time. Following selection of the panel members the members are interlocked together by sliding the locking bead 42 of each panel member longitudinally into the interior of the C-shaped locking clasp 44 of the above member. The bead 42 on the uppermost member is slid longitudinally into the interior of the locking clasp 48 of top member 16. The beads fit snugly within the locking clasps to hold the members together in the assembly.

Members 14 and 16 are preferably formed from sections of extruded plastic material. If desired, the members may be formed from other materials, including aluminum extrusions and the like.

The interlocked panel member—top member assembly is fitted into the frame 12 by lowering assembly through the slot 56 at the top of the frame between top rails 26 and 28. The longitudinal length of panel members 14 and top member 16 permits them to fit snuggly within the inwardly facing channels 24 of members 20 and 22 as illustrated in FIG. 3. When the interlocked panel assembly 36, and top member are fully inserted into frame 12 the locking clasp 44 of the lowermost panel member 14 is snapped over the locking bead 34 on the top of the bottom rail 30 as indicated in FIG. 2 to secure the bottom of the assembly within the frame 12. The top plate 50 rests flush on the upper surfaces of the top rails 26 and 28 and the upper surfaces of the upright members 20 and 22 and forms a roof overlying the slot 56 and interlocked members. The roof protects the sign from snow and ice which make panel replacement difficult. In this manner, the channel members 20 and 22, locking bead 34 and top of the frame firmly support the members.

Unauthorized removal of the panels from the sign frame is prevented by lock 18 which extends through lock openings 60 in top rails 26 and 28 and lock opening 62 formed through the body of the top member 16. When the panel assembly 36 is fully positioned within the frame 12 as shown in FIG. 1 the openings 60 and 62 are aligned permitting the lock to be piloted through the openings and then closed so that both ends of the lock extend beyond the openings 60 and the secure the assembly within the frame.

The modular sign 10 is particularly useful for advertising real estate offerings, business sales and other commercial news where a permanent message may be displayed on one panel and different messages may be displayed at different times on other panels. The panels are easily changed by removing the lock, lifting the assembly from the frame, replacing panels as required and then repositioning the assembly within the frame and locking the new assembly in place. There is no need to replace entire signs because part of an advertised message changes. Further, a given sign may be used for a large number of display purposes, without the necessity of specially preparing a sign panel for each purpose. An inventory of appropriate modular panels permits displays to be changed as required.

FIGS. 5 through 8 illustrate a second embodiment modular sign 70 including a rectangular frame 72 similar to frame 12, a assembly of interlocking panel members 74 like panel members 14, a top member 76 like top member 16 and a lock 78 like lock 18.

The frame 72 includes a pair of spaced upright channel members 80 and 82 with inwardly facing channels 84, a pair of spaced top rails 86 and 88 defining a slot 90 extending across the top of the frame and a bottom rail 92 joining the lower ends of the channel members 80 and 82. As illustrated in FIG. 7, bottom rail 92 is offset to one side of the channels 84. A locking bead 94 is secured to the top of the cross rail 92 centrally between the rails. Bead 94 is like bead 34.

The sign 70 is intended to be hung from the support and includes a pair of support rings 96 secured to the upper ends of the channel members 80 and 82. As illustrated in FIG. 6, the rings 96 extend over the upper ends of the members 80 and 82. A vertical slot 98 is formed in the upper end of channel member 80 in channel 84 to permit lateral insertion of the top member 76 through the rings and the slot 90.

After the appropriate modular panel members have been selected for display in frame 72 the panel members only are assembled as previously described by interlocking their adjacent beads and clasps to form a panel assembly indicated by bracket 100 in FIG. 5. The panel assembly is then loaded into the frame by moving the assembly upwardly into the channels 84 from the bottom and as indicated in FIG. 7. The members 74 are bowed slightly away from rail 92 as indicated in dotted lines in FIG. 7 in order to pass freely by locking bead 94 and to assure free clearance of the ends of the members as they move along the channels 84 to bottom rail 92 is laterally offset to facilitate bottom loading of assembly 100. When assembly has been fully inserted into the frame the assembly is allowed to relax to its normal planear position with the ends of the panel members seated within the channels. The lowermost panel member is then forced down against the locking bead to snap the locking clasp over the bead as shown in FIG. 6, thereby securing the assembly to the bottom rail.

After the panel assembly has been moved into the frame the top member 76 is piloted through slot 98 in channel member 80 so that the locking clasp of the top member engages the exposed bead 106 of the uppermost panel member and the member top plate rests flush on the top of the top rails 86 and 88 and channel members 80 and 82, as in sign 10. The rings 96 prevent the top member from being attached to the panel member assembly 100 prior to insertion into the frame.

Following side loading of the top member 76 lock 78 may be extended through lock openings 102 in the top rails 86 and 88 and lock opening 104 in the top member 76. The lock 78 prevents accidental and unauthorized disassembly of the panel members.

While I have illustrated and described preferred embodiments of my invention, it is understood that this is capable of modification, and I therefore do not wish to be limited to the precise details set forth, but desire to avail myself of such changes and alterations as fall within the purview of the following claims.

What I claim my invention is:

1. A modular sign including a rectangular frame having opposed vertical channel members with upper and lower ends defining a pair of inwardly facing channels, a top rail extending between the upper ends of the channel members and a bottom rail extending between the lower ends of the channel members, and panel member retention means on the bottom rail; an essentially flat assembly of panel members including a top panel member and a bottom panel member, each panel member including an elongate flat central panel having a pair of opposed display surfaces, a top locking element on the top of the central panel and a bottom locking element on the bottom of the central panel, said panel members extending from side to side across the width of the assembly with the top and bottom locking elements of adjacent panel members removably interlocked to secure the panel members together in the assembly; and an elongate top member including a roof, a body extending downwardly from the roof and a locking element on the bottom of the body; said assembly being confined within the interior of the frame with the ends of the panel members extending into the channels in the channel members, the bottom locking element of the bottom panel member extending past the bottom rail panel member retention means to retain the rail and bottom panel member together; the top member body extending along said top rail with the roof overlying the top rail and the top member body extending downwardly from the roof to one side of the rail, the ends of the body extending into the channels in the channel members adjacent the rail and the top member locking element removably interlocked with the top locking element of the top panel member of said assembly whereby the assembly and top member are removably confined within the frame.

2. A modular sign as in claim 1 including a second top rail extending between the upper ends of the channel members, a slot between the top rails, said roof extending over both said rails with the top member body joining the center of the roof and extending downwardly into the slot between the rails.

3. A modular sign as in claim 2 wherein said top member and panel members are of equal width and have uniform transverse cross sections, and one of said top or bottom locking elements is a bead and the other of said top or bottom elements is a C-shaped locking clasp, said bead having a sliding fit within said clasp to secure adjacent members together.

4. A modular sign as in claim 3 wherein the frame includes ground legs extending downwardly below the bottom rail.

5. A modular sign as in claim 3 wherein the frame includes mounting rings adjacent the top rails for mounting the sign from a support located above the frame.

6. A modular sign as in claim 3 including a lock removably securing the top member to at least one of said top rails.

7. A modular sign as in claim 6 including lock openings extending through said top rails and said top member body, said lock extending through all of said openings.

8. A modular sign as in claim 2 including a slot in the top of one of the channel members extending downwardly a distance not less than the width of the top member body below the roof whereby the top member may be side loaded through the slot and into the interior of the sign for engagement with the top locking element on the upper panel member in the assembly.

9. A modular sign as in claim 8 wherein the bottom rail is laterally offset with respect to the opposing channels in said channel members to permit bottom loading of the assembly into the frame.

10. A modular sign as in claim 1 wherein the panel member retention means on the bottom rail is centrally located with respect to the channels of said channel members.

11. A modular sign as in claim 1 wherein the bottom locking element of the bottom panel member engages the panel member retention means on the bottom rail.

* * * * *